United States Patent [19]

Bosserman et al.

[11] 4,024,391

[45] May 17, 1977

[54] PHOTOCATHODE AND MICROCHANNEL PLATE PICTURE ELEMENT ARRAY IMAGE INTENSIFIER TUBE AND SYSTEM

[75] Inventors: David A. Bosserman, Alexandria; Charles F. Freeman, Springfield, both of Va.

[73] Assignee: The United States of America as represented by the Secretary of the Army, Washington, D.C.

[22] Filed: Apr. 9, 1976

[21] Appl. No.: 675,367

[52] U.S. Cl. ..... 250/213 VT; 250/207; 313/105 CM

[51] Int. Cl.[2] ..... H01J 39/12

[58] Field of Search ..... 250/213 R, 213 VT, 207; 313/103 R, 103 CM, 105 R, 105 CM; 315/12 R, 12 ND

[56] References Cited

UNITED STATES PATENTS

| | | | |
|---|---|---|---|
| 3,612,944 | 10/1971 | Requa et al. | 313/105 CM |
| 3,947,841 | 3/1976 | Tumolillo | 250/207 |
| 3,974,331 | 8/1976 | Pepin | 250/213 VT |

*Primary Examiner*—David C. Nelms
*Attorney, Agent, or Firm*—Nathan Edelberg; Max L. Harwell; Robert P. Gibson

[57] ABSTRACT

A picture element array image intensifier tube display device and system for providing image analysis and processing schemes for an image in either direct or remote view. The picture element array comprises an array of electrically isolated parallel photocathode stripes that are adjacent and orthogonal to a microchannel plate input electrode array of electrically isolated parallel metallic stripes which have differential bias voltages selectively switched thereacross in some selective scan mode wherein said bias voltages are varied according to image analysis and processing schemes in a feedback circuit.

4 Claims, 6 Drawing Figures

PHOTOCATHODE AND MICROCHANNEL PLATE PICTURE ELEMENT ARRAY IMAGE INTENSIFIER TUBE AND SYSTEM

The invention described herein may be manufactured, used, and licensed by or for the Government for governmental purposes without the payment of any royalty thereon.

BACKGROUND AND SUMMARY OF THE INVENTION

The present invention is in the field of night viewing devices, and especially to devices that may comprise either an objective lens input imaging means at the input for use as head mounted goggles or a larger non-head mounted infrared scanner imaging means in which either type input may be used in either direct viewing or as a camera tube for remote viewing of some external scene.

The present embodiments are improvements over previous infrared (IR) imagers in that the present imagers provide a readout in either direct or remote view that has a 1:1 ratio IR image matrix to display matrix mapping. Also, the present embodiments eliminate aliasing which is present in other known sampling and display techniques.

The above mentioned improvements are accomplished in the embodiments of this invention. One embodiment is a "smart" direct view picture element array image intensifier night vision device which uses image analysis signals and process control schemes for analyzing these signals and makes decisions based on a comparison of built-in memory to feed back image enhancement signals to the picture element array. Another embodiment is an image intensifier camera used for recording and for remote viewing of digitized intensity of the array of picture elements at the output.

Both embodiments use a two dimensional picture element (PIXEL) array image intensifier comprising a photocathode and microchannel plate (MCP) having orthogonal arrays of electrically isolated strips that are individually connected to tube electronic means and array switching means for sequentially switching differential bias voltages on each of the interfacing stripes in some selective scan mode to provide accelerating or repressive voltages between cross-over areas.

DETAILED DESCRIPTION OF THE PREFERRED EMBODIMENT

Figure 1:
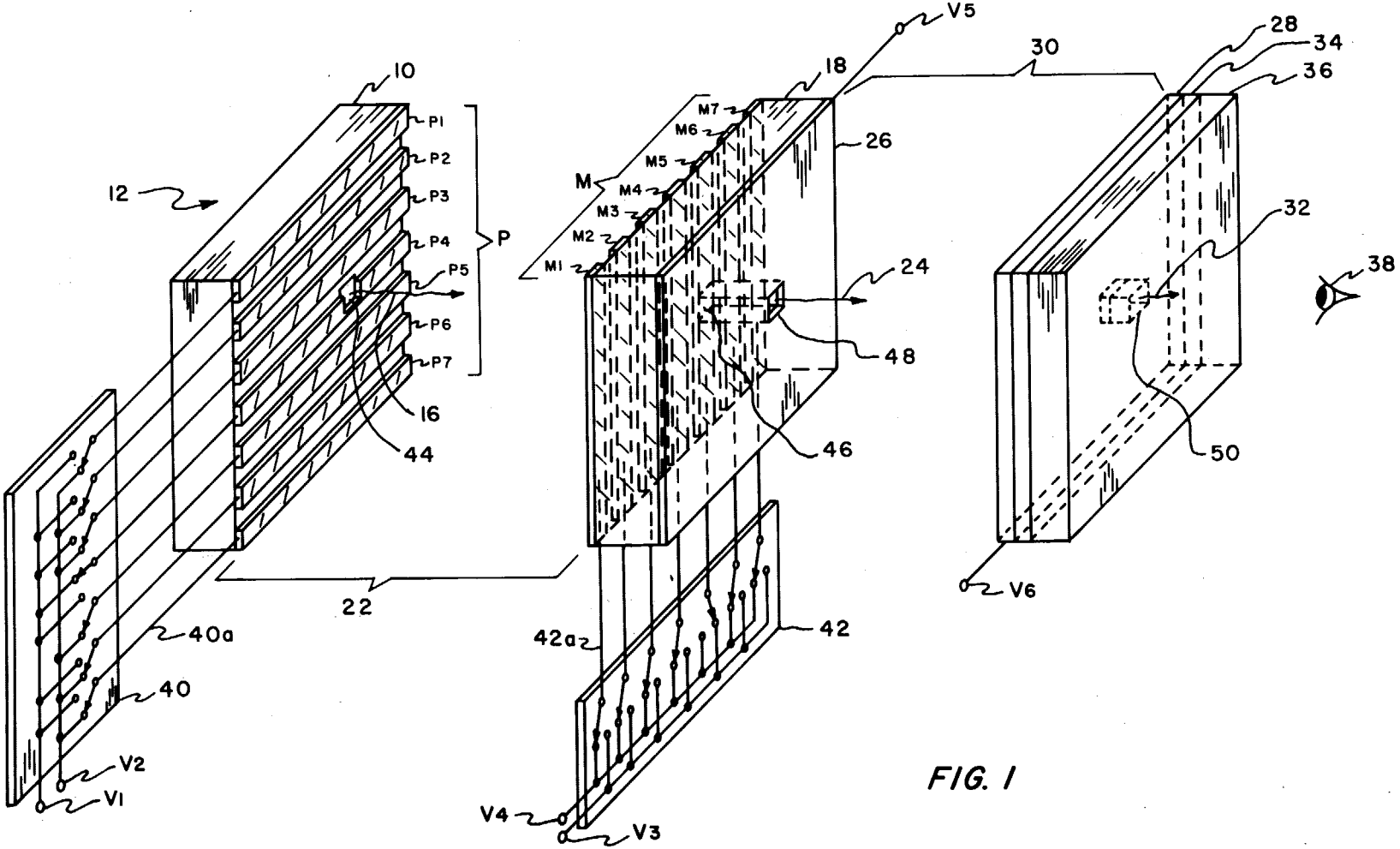
FIG. 1 shows a schematic of a photocathode and microchannel plate PIXEL array image intensifier direct view tube in wafer tube mode.

FIG. 1 shows a schematic of the photocathode and MCP PIXEL array image intensifier tube as used in the present "smart" direct view image intensifier. The PIXEL array is formed by a photocathode that is comprised of a plurality of electrically isolated parallel photocathode array stripes, represented by P, that are mounted on the inside of a transparent input faceplate 10 and a MCP 18 that has as an input electrode a plurality of electrically isolated parallel input electrode array metallic stripes, represented as M, that are positioned adjacent to and in proximity focus with P and orthogonal thereto. The photocathode array stripes P may be made of cesiated antimonide, such as S1 or S20 cathode material.

The PIXEL array only shows a 7 × 7 picture element array for reasons of simplicity of explanation. A typical embodiment would however have about 360 × 480 PIXELS, representing the adjacent faces, or cross-over areas, between the photocathode array stripes P and the MCP input electrode array stripes M. MCP 18 has a conventional continuous type electode 26. Stripes M may be formed on MCP 18 by various methods, such as evaporation through a mask for laying the parallel lines or by evaporating a continuous electrode and then photoetching the parallel lines therein in a manner similar to that used to produce printed circuits.

Figure 2:
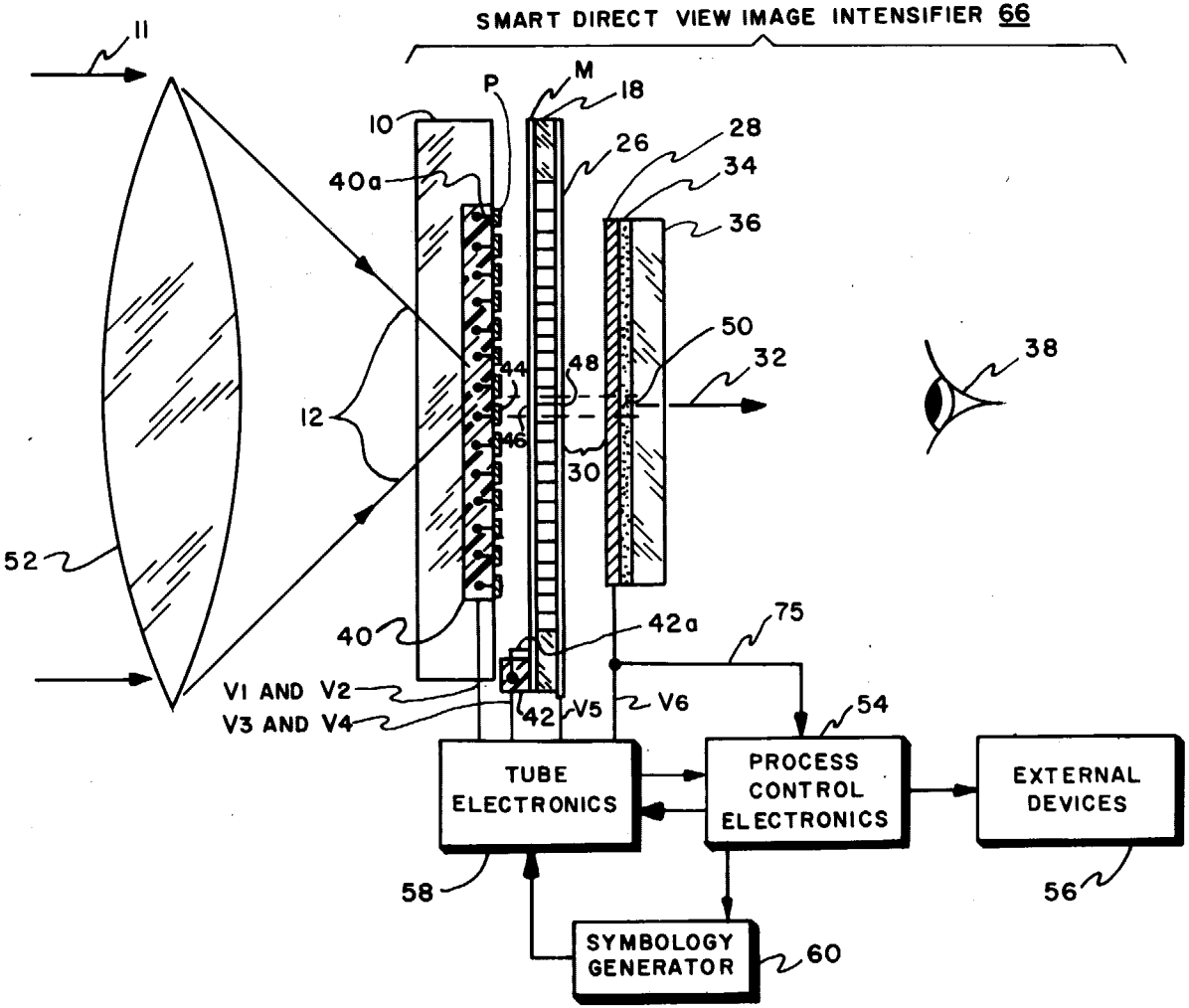
FIG. 2 is a side-view schematic of a head mountable smart direct view photcathode and microchannel plate PIXEL array image intensifier.

Looking at both FIGS. 1 and 2 the image intensifier tube has an output means comprising a phosphor electrode formed by phosphor layer 34 and a very thin metallic phosphor electrode 28 contiguous therewith the phosphor layer deposited on the inside of a transparent output faceplate 36, such as glass or fiber optics. The output means further has an output circuit, represented in FIG. 2 by lead 75, that is connected between the phosphor electrode 28 and a process control electronic means 54 for presenting digitized current intensity from each PIXEL of the picture element array as focused on phosphor layer 34.

Phosphor electrode 28 is in proximity focus with continuous output electrode 26 of MCP 18 in accordance with the voltages applied thereto, represented as V5 and V6. Voltage V5 is typically 1,000 d.c. volts and voltage V6 is about 6,000 d.c. volts for establishing a MCP-phosphor electrode proximity focus space 30 of 5.000 d.c. volts.

Binary voltages, represented as V1 and V2, are shown as being available for switching onto individual strips P1 through P7 over a plurality of connecting leads 40*a* by photocathode array switching means 40 and binary voltages, represented as V3 and V4, are shown as being available for switching onto individual stripes M1 through M7 over a plurality of connecting lead 42*a* by MCP input electrode array switching means. Cross-over voltage V1 and V2 between the P and M stripes are indicated as being the proper differential bias voltages needed to accelerate photoelectrons across the photocathode-MCP proximity focus space 22. Photocathode array stripe P4 is shown connected to voltage V1 and MCP input electrode array stripe M5 is shown connected to voltage V3. All of the other P stripes are connected to voltage V2 and all the other M stripes are connected to voltage V4, which results in a repressive voltage in space 22. The cross-over area between photocathode array stripe P4 and MCP input electrode array stripe M5 is defined as an active PIXEL. Cross-over area 44 indicates an active photocathode PIXEL that interfaces with MCP array PIXEL 46 and is in-line with MCP output PIXEL 48 and the phosphor PIXEL 50 to form a continuation of one activated PIXEL. Typical values of voltage V1 through V4 are as follows: V1 is at ground potential; V3 is +10 d.c. volts; V2 is +10 d.c. volts; and V4 is at gound potential. The acceleration voltage V1 and V3 are a positive 10 d.c. volts that provide accelerating voltages for photoelectrons 16 while voltages V2 and V4 present a repressive voltage of a negative 10 d.c. volts to other cross-over areas. These voltages are appropriate for a proximity focus spacing 22 of 0.0002 inches between the P and M stripes. A typical switching rate may be at 5 MHz.

Look now at both FIGS. 1 and 2 for an explanation of the smart direct view PIXEL array image intensifier and system. The adjective "smart" denotes the use of process control electronic means to analyze output data and perform functions as a result of this analysis and is discussed more fully hereinbelow.

An input imaging means, comprising an objective lens 52 designed for distant viewing, images target radiation 12 from some external scene, represented as incoming radiation 11. Lens 52 images radiation 12 through an input substrate 10, such as glass or fiber optics, that is transparent to the target radiation 12, and over the plurality of electrically isolated parallel photocathode array stripes P.

Tube electronic means 58 comprises a plurality of power supply bias voltages that are applied to various elements of the smart direct view image intensifier tube 66 and has drivers for supplying clock pulses to photocathode array switching means 40 and to MCP input electrode array switching means 42. The photocathode array switchng means 40 and MCP array switching means 42 are logic switching circuits, such as solid state shift registers or a charged coupled device on a chip, that switch array bias voltages V1 through V4, which are available within the tube electronic means 58 and are switched on leads 40*a*of 40 or leads 42*a* of 42 onto individual stripes of said photocathode and MCP input electrode array stripes in some selected scan mode or addressing scheme. Bias voltages V5 and V6 are also a part of tube electronic means 58 and are connected respectively to MCP 18 output electrode 26 and to phosphor electrode 28. The particular scan mode used is established by switching means 40 and 42. The drivers within tube electronic means 58 serve to active switching means 40 and 42 into their scan mode. Random access memory (RAM) or read only memory (ROM) may also be used to establish the scan mode but due to their size would need to be outside the tube.

The rate that the drivers drive the array switching means 40 and 42 is typically 5MHz as noted above. However, there may be various address schemes used to activate individual PIXELs or groups of PIXELs. One address scheme is that of switching one of the accelerating bias voltages V1 or V3 on one of their respective array stripes along either connecting leads 40*a* or 42*a* while the other is linearly sequentially switched so that all of the other accelerating bias voltages V1 or V3 are switched across the other array stripes by way of either connecting lead 40*a* or 42*a*. In FIG. 1, for example, voltage V1 may remain on photocathode array stripe P4 while voltage V3 is sequentially switched onto all of the MCP input electrode array stripes M1 through M7. Many other scanning schemes may be used, such as scanning by groups of array stripes, interlace sequential scanning, read only memory, random access memory, etc..

The smart direct view image intensifier uses process control electronic means 54 having a built-in program comparison means therein for comparing the digitized current intensity of the active PIXELS on phosphor electrode 28 as a first input to 54 by way of lead 75. The digitized current intensity of the active PIXELs are synchronized with position scan data timing pulses since these timing pulses are produced simultaneously with the clock pulses from the drivers that activate switching means 40 and 42. The position scan data timing pulses are applied as a second input to the process control electronic means 54.

The process control electronic means 54 looks at the phosphor electrode of the output means for such things as movement, symbology, cueing, etc. The built-in program comparison means within 54 preferably uses logic circuitry for detecting motion and for image pattern recognition by detecting changes in the digitized current intensity from the active PIXELs compared with some built-in program on a digital frame-to-frame basis synchronized by the position scan data timing pulses from tube electronic means 58. Since the position scan data timing pulses are also synchronized with the clocked drivers for switching means 40 and 42, the comparison is in real time.

A first output from 54 is applied to some external devices 56. The first output comprises any difference signal as a result of comparison with said built-in program and said digitized current intensity on lead 75. External devices 56 may be bells, lights, or other alarm devices that may alert an operator to, for example, movement of an object in the external scene even though the operator is not actually directly viewing the output visible image radiation 32, as represented by eye 38. A second output from 54 comprises cueing signals that are applied to symbology generator 60 that further tells tube electronic means 58 to superimpose or write symbology or some figure on the output visible image radiation by supressing d.c. voltage levels on the P and M stripes. Cueing may utilize symbology already present on the display or the symbology generator 60 in applying symbology therein. A third output from 54 comprises a feed back loop for changing the image intensifier tube parameters including any of the bias voltages within tube electronic means 58 in accordance with the analysis of the digital current intensity from the phosphor electrode 28.

The feedback loop may control the brightness level and gain of the image intensifier by applying an additional d.c. voltage — either positive or negative as required — to voltage terminal V5 connected to the output electrode 26 of MCP 18 for controlling the electron gain of MCP 18. Included in the comparison analysis may be such features in the feedback loop as contrast and edge enchancement or shaping.

Figure 3:
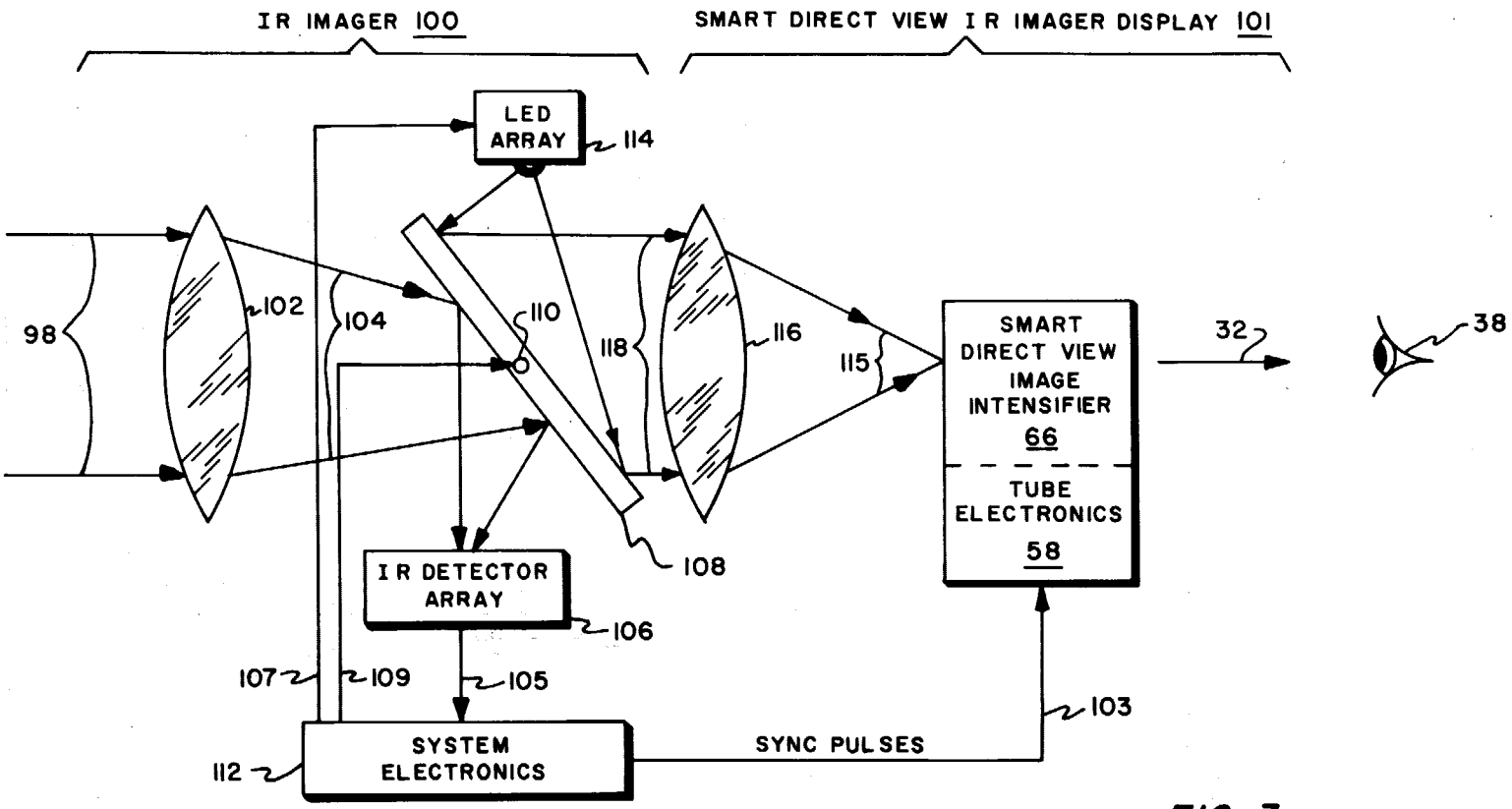
FIG. 3 illustrates an infrared imager input to the embodiment of FIG. 2.

FIG. 3 illustrates a smart direct view infrared (IR) image display. In this embodiment, an IR image 100 replaces the objective lens 52 of FIG. 2 and synchronizing pulses from system electronic means 112 on lead 103 are applied to the drives within tube electronic means 58 for synchronizing the photocathode array switching means 40 and the MCP input electrode switching means 42 with the scanning mirror 108 in IR image 100. The output from 112 along lead 103 is herein stated as a third output from 112.

The IR image 100 has an objective lens 102 which images target radiation 104 from some external scene, represented as incoming radiation 98, onto an IR photodetector array 106 after being reflected off the front side of a flat two-reflective side IR scanning mirror 108 that is in the optical path between lens 102 and array 106. Mirror 108 has a central scan axis 110 about which mirror 108 is oscillated by signals from a first output from system electronic means 112 along lead 109 in such a way as to scan the image of the photodetector array 106 across the field-of-view of the external scene. Mirror 108 is driven by 112 at a rate faster than the human eye can detect. Signals from the photodetector array 106 are applied to system electronic means 112 by lead 105. System electronic means 112 electronically processes these signals to drive a plurality of light emitting diodes (LEDs) along a second output along lead 107. The plurality of LEDs form an LED array 114 which is matched element-for-element with photodetectors in the photodetector array 106. Output radiation 118 from LED array 114 is normally viewed as reflected from the back side of mirror 108 by means of a suitable eyepiece. In the present invention however the output radiation 118 is scanned off the back side of mirror 108 and is relayed by suitable relay optics 116 to one stripe each of the electrically isolated photocathode array stripes P of the smart direct view IR imager display 101.

Figure 4:
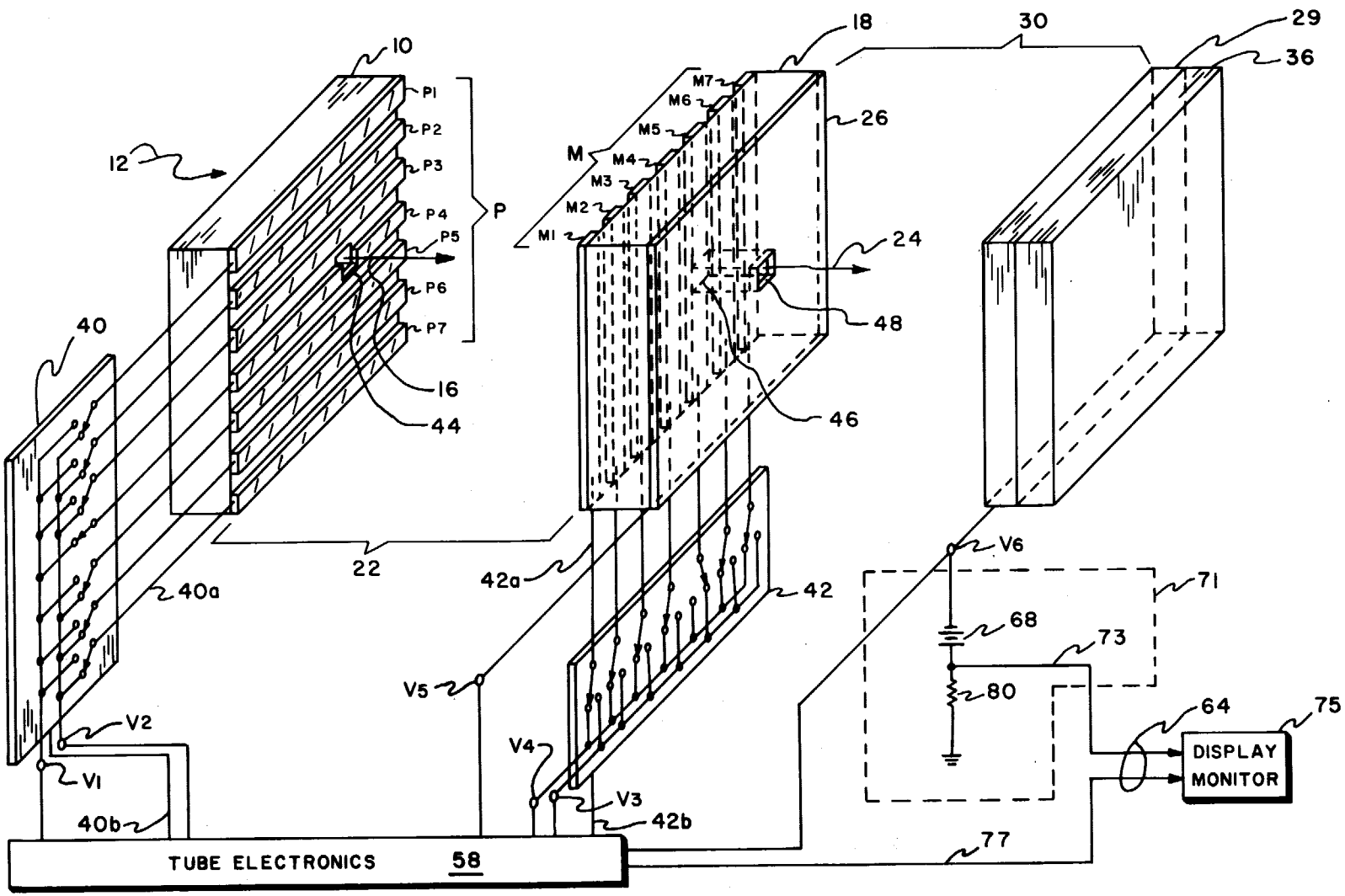
FIG. 4 shows a schematic of a photocathode and microchannel plate PIXEL array image intensifier camera tube in wafer tube mode.

FIG. 4 shows a schematic of the photocathode and MCP PIXEL array image intensifier camera tube used in remote viewing. The P and M stripes their switching means 40 and 42 are the same as for the smart direct view image intensifier shown in FIG. 1. The output means however does not have a phosphor layer thereon and does not have to be in proximity focus with the continuous MCP 18 output electrode 26. Tube electronic means 58 of the image intensifier camera tube not only comprises the power supply bias voltages to terminals V1 through V6 and drivers fo supplying clock pulses to the photocathode array switching means 40 along leads 40*b* and the MCP input electrode array switching means 42 along leads 42*b* but generates position scan data signals along lead 77 to a display monitor 75. A digitized current intensity signal on lead 73 is in synchronism with the position scan data signals along lead 77 to produce an overall video amplitude signal designated as 64, as a real time input to display monitor 75.

Figure 5:
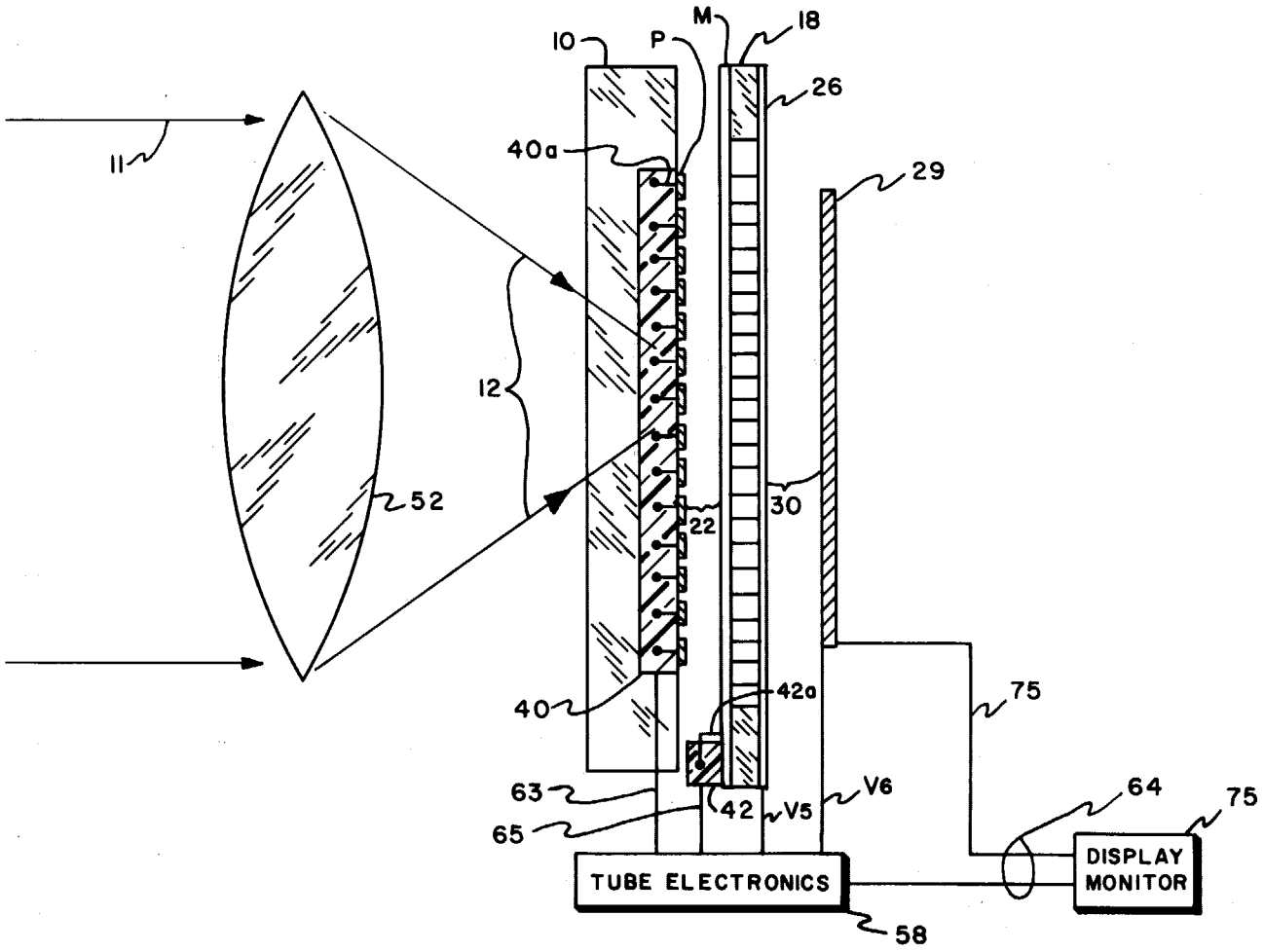
FIG. 5 is a side-view schematic of the tube of FIG. 4.

The output means of the image intensifier camera tube is comprised of a metal collector plate 29, which may be a metallized film on a glass output faceplate 36, as shown in FIG. 4, or may be a solid metal plate 29 alone, as shown in FIG. 5, and an output circuit 71. Output circuit 71 has a voltage source 68 and resistor 80 connected in series between the metal collector plate 29 and ground wherein the digitized current intensity from the collector plate for each picture element of the PIXEL array is sampled at a junction between voltage source 68 and resistor 80. The display monitor 75, into which the video amplitude signal 64 is applied, may be an electric tape, computer, etc.. Also, signal 64 may be applied to the process control electronic means 54 of the smart direct view image intensifier the same as the digitized current and position scan data timing pulses are applied as shown in FIG. 2 and the image on the camera be changed to direct view. However, it is essential that both of the photocathode array switching means and both of the MCP input electrode array switching means be synchronized with each other and their respective electrically isolated stripes be of the same dimension.

Look now at FIG. 5 wherein the image intensifier camera tube is shown as having an objective lens 52 input imaging means for imaging target radiation 12 from some external scene, represented as incoming radiation 11, over photocathode array stripes P. Lead 63 from tube electronic means 58 represents bias voltages V1 and V2 and lead 40*b* as shown by FIG. 4, and lead 65 from 58 represents bias voltages V3 and V4 and lead 42*b* shown in FIG. 4. Collector plate 29 is shown only as a solid metal plate that is not mounted on an output faceplate. Lead 75 represents an output circuit from collector 29.

Figure 6:
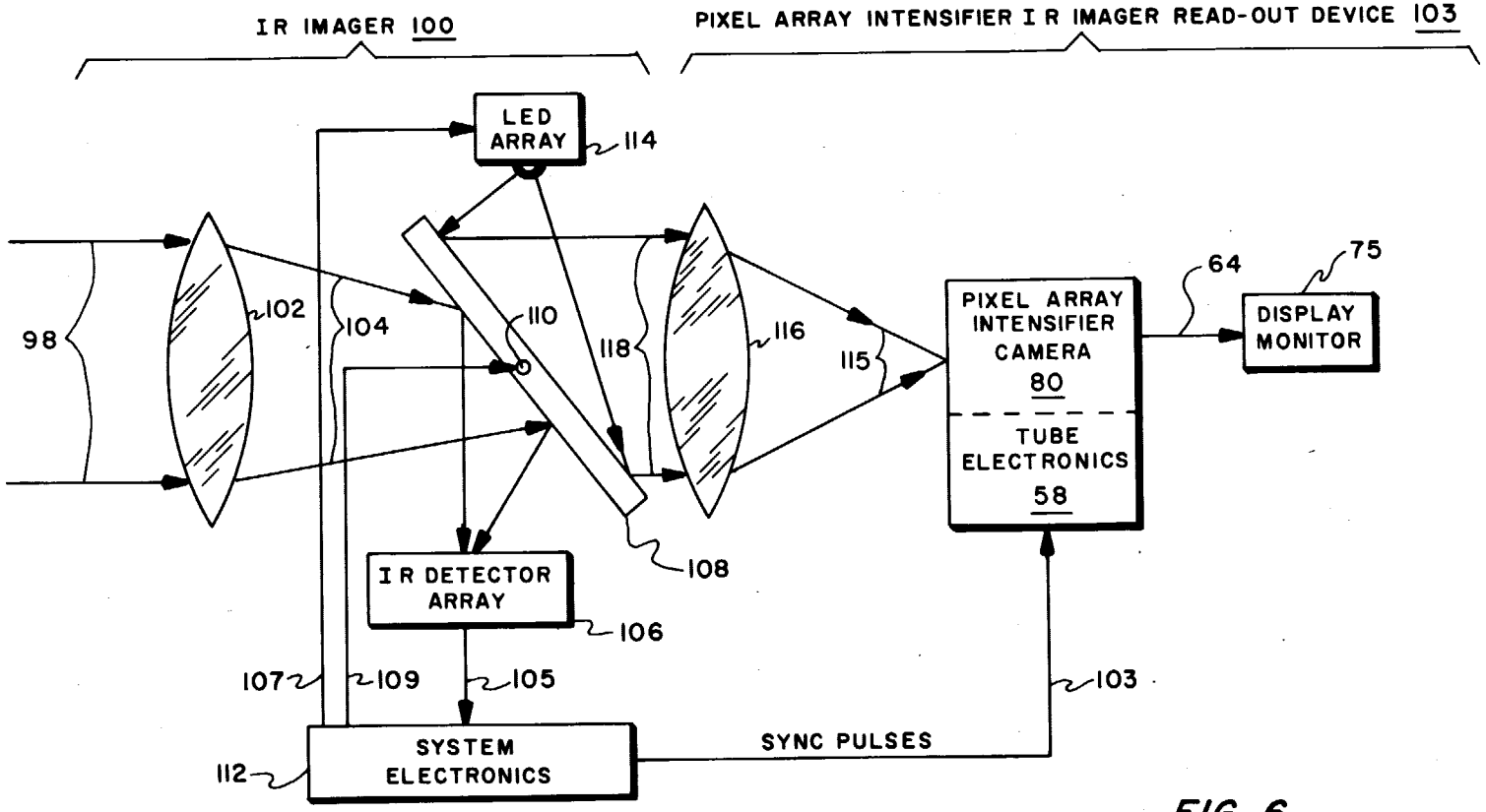
FIG. 6 illustrates an infrared imager input to a readout tube of FIG. 5.

FIG. 6 illustrates an IR imager 100 input imaging means that images radiation onto the photocathode array stripes P of the PIXEL array image intensifier camera 80 as discussed above with reference to FIGS. 4 and 5. In this embodiment, the IR imager 100 replaces the objective lens 52 and synchronizing pulses from system electronic means 112 on lead 103 are applied to the drivers within tube electronic means 58 for synchronizing the photocathode array switching means 40 and the MCP input electrode array switching means 42 with the scanning mirror 108. The output from 112 along lead 103 is stated herein as a third output from 112.

The IR imager 100 has the same components and operates the same way in relation to the PIXEL array intensifier IR images read-out device 103 as that discussed above with reference to FIG. 3 as an input imaging means for the smart direct view IR imager display 101.

While the invention has been described with reference to different preferred embodiments, it will still be apparent that other modifications and embodiments thereof will occur to those skilled in the art within the scope of the invention. Accordingly, it is desired that the scope of the invention be limited only by the appended claims.

We claim:

1. A picture element array image intensifier tube and system for direct viewing of an image of an external scene, the tube and system comprising:

an input imaging means for presenting said image of an external scene over the input side of a transparent input faceplate;

a plurality of electrically isolated parallel photocathode array stripes mounted on the inside of said transparent input faceplate;

a microchannel plate electron multiplier having as an input electrode a plurality electrically isolated parallel input electrode array of metallic stripes and a continuous output electrode, said input electrode array of metallic stripes positioned adjacent and in proximity focus to said photocathode array stripes and orthogonal thereto;

an output means comprising a phosphor electrode on the inside of a transparent output faceplate and in proximity focus with said continuous output electrode of said microchannel plate electron multiplier for direct viewing of an intensified replica of said image of an external scene and an output circuit connected to said phosphor electrode for presenting digitized current intensity from each picture element of said picture element array;

photocathode array switching means;

microchannel plate input electrode array switching means;

tube electronic means having power supply bias voltages that are applied to image intensifier tube elements and array switching drivers for activating said switching means for selectively switching said bias voltages in some scan mode over individual stripes of said photocathode array stripes and over individual microchannel plate input electrode array of metallic stripes and further having position scan data timing pulses produced in synchronism with activation of said switching means; and process control electronic means having a built-in program therein and having as a first input said digitized current intensity from each picture element and having as a second input said position scan data timing pulses in synchronism with activation of each picture element by said switching drivers to produce a video type signal and for analysis of each picture element on a digital frame-to-frame basis by comparison of said built-in program with digitized current intensity from each picture element in which said process control electronic means has first, second, and third outputs therefrom wherein said first output is a difference signal that is applied to an external display device and said second output activates a symbology generator according to said built-in program for applying symbology bias voltages through said tube electronic means to said photocathode array and said microchannel plate input electrode array and said third output comprises feedback of decisions based on comparison of said built-in program with said digitized current intensity in which said decisions are applied to said tube electronic means for changing said bias voltages to enhance said intensified image.

2. A tube and system as set forth in claim 1 wherein said input imaging means is an objective lens for projecting the image from said external scene onto said photocathode array stripes.

3. A tube and system as set forth in claim 1 wherein said input imaging means are infrared scanners having optical and system electronic means comprising:

an objective lens for imaging target radiation from the field-of-view of some external scene;

a photodetector array;

a flat two-reflective side infrared scanning mirror positioned with the front side thereof in the optical path between said objective lens and said photodetector array and having a central scan axis about which said scan mirror oscillates to sweep the field-of-view of said external scene across said photodetector array;

a plurality of light emitting diodes forming a light emitting diode array that is electronically connected element-for-element to said photodetector array;

system electronic means for processing the signals from said photodetector array and having first, second, and third outputs therefrom wherein said first output drives said scan mirror about its central scan axis at a rate faster than the human eye can detect and said second output drives said light emitting diode array and said third output is synchronizing pulses applied to said tube electronic means to synchronize said scanning mirror with said array switching drivers; and relay optics, said relay optics positioned in the optical path between the back side of said scan mirror that reflects the output radiation of said light emitting diodes and said plurality of electrically isolated photocathode array stripes wherein the output radiation from each of said plurality of light emitting diodes is relayed by said relay optics to one element of each of said plurality of electrically isolated parallel photocathode array stripes for processing by said process control and tube electronic means.

4. A picture element array image intensifier camera tube and system for remote viewing of an image of an external scene, the tube and system comprising:

an input imaging means for presenting said image of an external scene over the input side of a transparent input faceplate;

a plurality of electrically isolated parallel photocathode array stripes mounted on the inside of said transparent input faceplate;

a microchannel plate electron multiplier having as an input electrode an electrically isolated parallel input electrode array of metallic stripes and a continuous output electrode, said input electrode array of metallic stripes positioned adjacent and in proximity focus to said photocathode array stripes and orthogonal thereto;

an output means comprising a metal collector plate positioned on the internal side of a glass output faceplate adjacent said continuous output electrode of said microchannel plate electron multiplier and an output circuit connected to said metal collector plate for presenting digitized collector plate current intensity from each picture element of said picture element array;

photocathode array switching means;

microchannel plate input electrode array switching means;

tube electronic means having power supply bias voltages that are applied to image intensifier tube elements and clock pulse producing means for activating said switching means for selectively switching said bias voltages in some scan mode over individual stripes of said photocathode array stripes and over individual microchannel plate input electrode array of metallic stripes and further having position scan data produced in synchronism with activation of said switching means; and a display monitor for combining and analyzing said digitized collector plate current intensity with said position scan data and presenting a video amplitude signal therefrom.

* * * * *